US006282745B1

(12) United States Patent
Alt

(10) Patent No.: US 6,282,745 B1
(45) Date of Patent: Sep. 4, 2001

(54) LOBBY DUST PAN

(75) Inventor: Steven J. Alt, Perrysburg, OH (US)

(73) Assignee: Impact Products, Inc., Toledo, OH (US)

( * ) Notice: Subject to any disclaimer, the term of this patent is extended or adjusted under 35 U.S.C. 154(b) by 0 days.

(21) Appl. No.: 09/388,116

(22) Filed: Sep. 1, 1999

(51) Int. Cl.[7] ..... A47L 13/52
(52) U.S. Cl. ..... 15/257.4; 15/257.7
(58) Field of Search ..... 15/257.1–257.9; 294/53.5

(56) References Cited

U.S. PATENT DOCUMENTS

| | | | | |
|---|---|---|---|---|
| 248,344 | * | 10/1881 | Perry | 15/257.7 |
| D. 276,668 | | 12/1984 | Minniman | D3/7 |
| 390,781 | | 10/1888 | Hebden et al. | 15/257.7 |
| D. 402,780 | | 12/1998 | Alt | D32/74 |
| 445,278 | * | 1/1891 | Chubb | 15/257.1 |
| 531,177 | | 12/1894 | Gere | 15/257.4 |
| 1,203,697 | | 11/1916 | Bump | 15/257.4 |
| 1,315,310 | * | 9/1919 | Kelley | 15/257.1 |
| 1,329,915 | | 2/1920 | McKenzie | 135/65 |
| 1,683,517 | * | 9/1928 | Bentley | 15/257.1 |
| 2,978,731 | | 4/1961 | Belluomini | 15/257.4 |
| 4,834,127 | | 5/1989 | Van Sice | 135/76 |
| 4,837,666 | | 6/1989 | Conkle | 362/102 |
| 5,343,589 | | 9/1994 | Davenport | 15/257.4 |
| 6,023,812 | * | 2/2000 | Morad | 15/257.7 |

FOREIGN PATENT DOCUMENTS

| | | |
|---|---|---|
| 6704 | 4/1894 | (GB) . |
| 2011566 | 7/1979 | (GB) . |
| 1694096 | 11/1991 | (SU) . |

* cited by examiner

*Primary Examiner*—Mark Spisich
(74) *Attorney, Agent, or Firm*—Donald R. Fraser

(57) ABSTRACT

A lobby dust pan of the type generally having a receptacle portion pivotally connected to a yoke. The yoke is flexible and is connected to a shaft. The yoke is deformable to enable a latch thereon to be retained with or released from suitably disposed openings in the receptacle. A shaft in turn has a handle connected to the upper end, and the other end connected to the yoke. The yoke is provided with an array of spaced apart outwardly projections or teeth suitable for assisting in the removal of debris from the user's broom, brush, or the like.

1 Claim, 2 Drawing Sheets

LOBBY DUST PAN

BACKGROUND OF THE INVENTION

1. Field of the Invention

The present invention relates to waste receptacles. More particularly, the present invention relates to a lobby dust pan of the type having a receptacle portion mounted to a shaft through a pivotally mounted yoke.

2. Description of the Prior Art

Dust pans of the general type described herein are known in the prior art. Lobby dust pans have long been needed for cleaning small bits of waste, such as gum wrappers, candy wrappers, and other types of waste, from commercial areas, such as theaters and building lobbies.

Generally, such lobby dust pans have a receptacle portion, which is pivotally mounted by various means well known in the art, to a shaft. The shaft is, in turn, connected to a ball-shaped handle, for example.

When the immediate area is properly cleaned of the waste, downward pressure is once again placed on the handle. The downward pressure causes the hook-like tab to disengage from the slot. When the handle is lifted, the receptacle portion is so weighted that it will rotate to a position of axial alignment with the shaft to prevent the waste in the receptacle from falling out.

SUMMARY OF THE INVENTION

To solve the problems longstanding in the prior art, a lobby dust pan having the known receptacle portion pivotally connected to a yoke is provided. The yoke is connected to one end of a shaft, the other end of which is connected to a handle.

At least a portion of the outwardly facing edge surface is provided into an array of teeth to facilitate the cleaning of debris from an accompanying broom, brush, or the like.

It is an object of the invention to provide an improved lobby dust pan having a novel yoke portion.

A further object of the present invention is to provide an improved lobby dust pan having ergonomic benefits for the user.

A still further object of the present invention is to provide an improved lobby dust pan which is less fatiguing to the user.

Other objects and advantages of the invention will become apparent from reading the following detailed description of the invention and appended claims, reference being had to the accompanying drawings forming a part of the specification, wherein like reference characters designate corresponding parts in the several views.

It is to be understood that the present invention is not limited in its application to the details of construction, and arrangement of parts illustrated in the accompanying drawings, since the invention is capable of other embodiments, and of being practiced or carried out in various ways within the scope of the appended claims. Also, it is to be understood that the phraseology and terminology employed herein is for the purpose of description, and not of limitation.

DESCRIPTION OF THE PREFERRED EMBODIMENT

Figure 1:
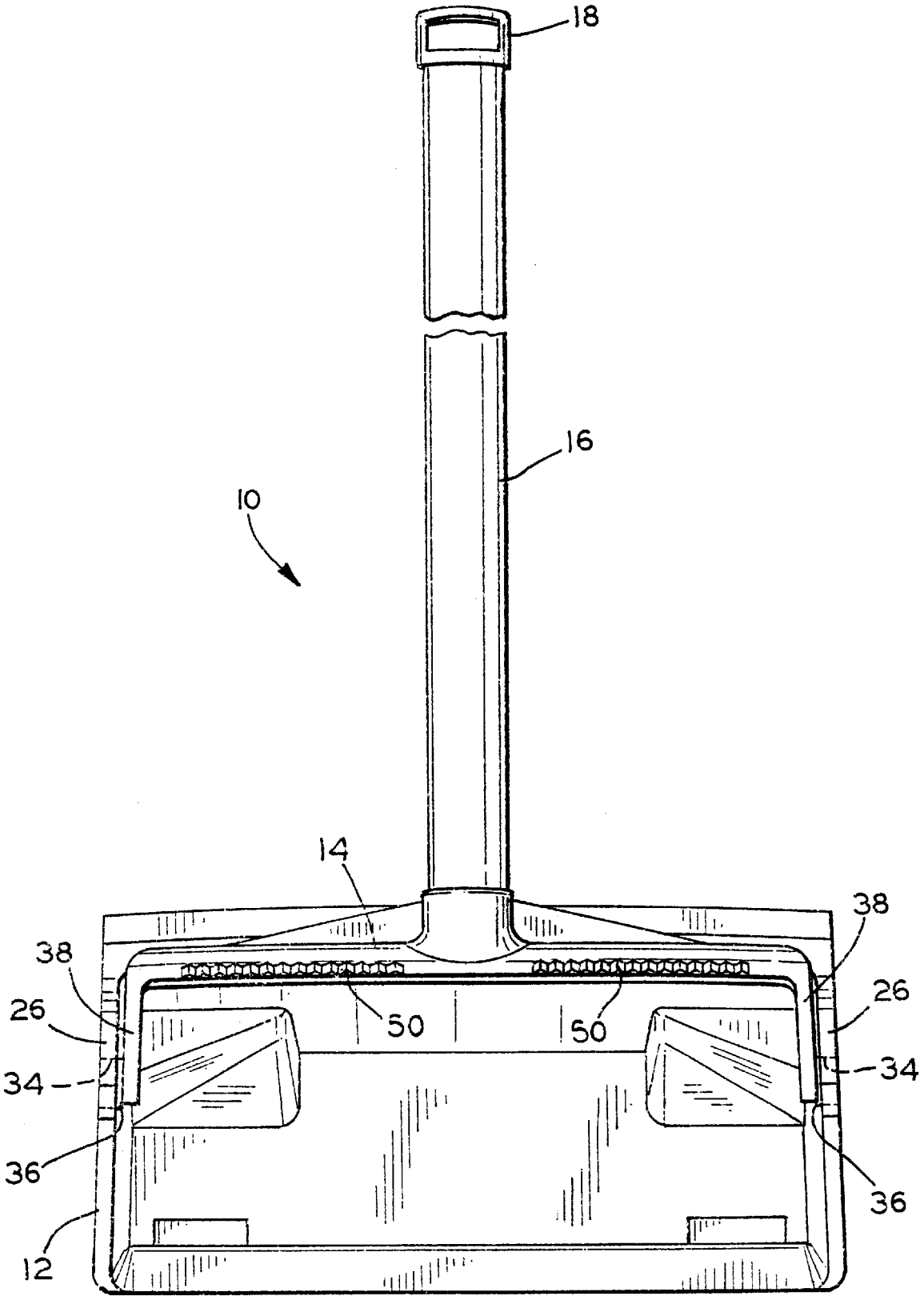
FIG. 1 is an elevational view showing a lobby dust pan embodying the present invention.
Figures 2, 3:
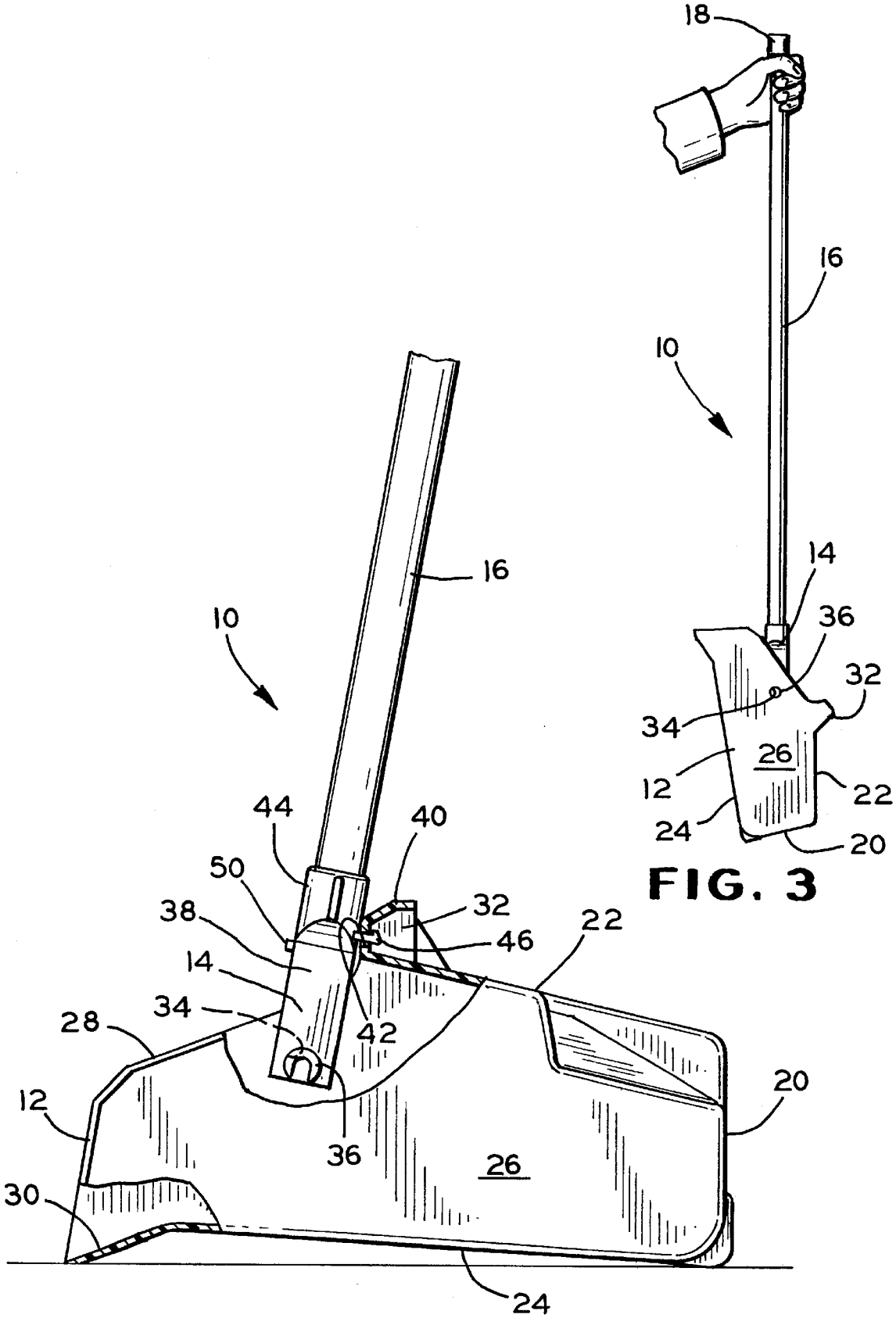
FIG. 2 is a right side view of the dust pan shown in FIG. 1, partially cut away for clarity, and showing the shaft in the upright latched position.
FIG. 3 is an elevational view showing the dust pan of FIGS. 1 and 2 with the receptacle in a debris carrying position.

Referring now to FIGS. 1 and 2, there is shown a lobby dust pan embodying the present invention, and generally designated by the numeral 10. Such lobby dust pans generally have a receptacle portion 12 which is pivotally connected to a yoke 14. The yoke 14 is connected to one end of a shaft 16. The other end of the shaft 16 is connected to a handle 18. The receptacle portion 12 of the lobby dust pan 10 is well known in the art, and typically includes a bottom wall 20, front wall 22, a rear wall 24, and a pair of parallel spaced apart side walls 26. The open ends of side walls 26 generally have a diagonal edge portion 28 forming a lip 30 at one end thereof, and an extension 32 at the other end.

The receptacle portion 12 of the lobby dust pan is shown in an active position in FIGS. 1 and 2. The receptacle 12 is mounted to the shaft 16 by rotary or pivotal hinge means which include a pair of axially aligned connecting openings 34 provided in the side walls 26 of the receptacle 12. A pair of mounting pins 36 are mounted in a 180° opposed relationship to a pair of downwardly depending legs 38 forming a part of the yoke 14.

The lobby dust pan 10 is provided with a rim portion 40 on which is formed a slot 42, as illustrated in FIG. 2. The slot 42 is formed proximate the midpoint of the rim 40. A shaft receiving or mounting socket 44 is provided at the upper extremity of the yoke 14. A tab 46 having a laterally extending hook-like portion is formed integrally with the shaft mounting socket 44.

As best seen in FIG. 2, when the receptacle 12 is placed on the surface to be cleaned, it will assume a horizontal position. The handle 18 and associated shaft 16 are, as shown in FIGS. 1 and 2, in an upright or locked position. In order to assume the position illustrated in FIG. 2, slight downward pressure is initially imposed on the handle 18. The pressure is transmitted through the shaft 16 and slightly deforms the body of the yoke 14 causing the tab 46 to move downward slightly. A rotation of the handle 18 (and shaft 16) in the clockwise direction, as observed in FIG. 2 will cause the hook-like portion of the tab 46 to enter and travel through the slot 42. When the operator releases the downward pressure on the handle 18, the tab 46 and hook move upward, and the handle 18 and the shaft 16 will be retained in the upright position for use by appropriate personnel. It can be seen that the lobby dust pan may be lifted and lowered many times and the receptacle portion 12 will remain in the horizontal or active position in the absence of a conscious effort to disengage the tab 46 from the slot 42.

It can be easily understood that when a person has completed the cleaning of a particular area, and wants to transport the lobby dust pan and the waste collected therein to another work area, a slight downward pressure on the handle 18 will again slightly deform the yoke 14 and permit release of the tab 46. A slight counter-clockwise rotation, as viewed in FIG. 2, about the axis of the connecting openings 34 will remove the tab 46 from the slot 42. Lifting on the handle 18 will permit the receptacle 12 to assume a vertical or inactive position, as illustrated in FIG. 3.

When the receptacle 12 is in the horizontal or active position, the user may easily sweep debris into the interior thereof. Oftentimes, some debris remains entangled or otherwise adhered to the bristles of the broom, for example. The debris then had to be manually removed from the broom, thereby creating an unsanitary and time consuming procedure. In order to facilitate the removal of the debris in a more sanitary and efficient manner, it was unexpectedly discovered that by forming an array of projections 50 extending from the yoke 14, as clearly illustrated in FIG. 1, such procedure could be accomplished.

Typically, the user may apply one foot onto the top of the receptacle 12 to assure that it does not move, and then place the bristles of the broom adjacent to the projections 50 and pull the broom upwardly. Such relative motion between the broom and the projections 50 has been found to effectively cause a dislodging of the warranted debris. The dislodged debris will fall into the receptacle 12 for later disposal.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A lobby dust pan comprising:

a) a receptacle which includes a generally flat, rectangular bottom wall, a rear wall extending transversely from the bottom wall, a front wall extending transversely, in the same direction as said rear wall, from the bottom wall to a height greater than the rear wall, said front and rear wall being spaced apart, and a pair of side walls extending transversely from the bottom wall, in the same direction as said rear wall, each side wall being coupled with the front and rear walls to form a continuous upper edge of all the walls which defines an aperture into said receptacle;

b) retaining means formed in the upper edge of the front wall for engaging a latching means, said retaining means including a slot formed in the upper edge;

c) a flexible yoke pivotally mounted to said pair of side walls and extending therebetween, said yoke containing a plurality of outwardly extending projections for assisting in the removal of debris from an associated broom, said receptacle being pivotal on said yoke between a first position in which the rear wall is generally horizontal and a second position in which the rear wall is generally vertical;

d) an elongate straight, vertical shaft having a bottom end and top end, said bottom end is secured to said flexible yoke at a position approximately midway between the pair of side walls, said yoke is movable between a deformed and an undeformed position by application of downward force on said shaft, and e) latching means for holding said yoke in the first position, said latching means formed on said yoke at a position adapted to engage said slot when said receptacle is in the first position, said latching means being retained in said slot, in the first position, when said yoke is in the undeformed position and released from said slot, in the first position, when the yoke is in the deformed position.

* * * * *